United States Patent [19]

Kokkeler et al.

[11] Patent Number: 4,841,111

[45] Date of Patent: Jun. 20, 1989

[54] MICROWAVE OVEN WITH IMPROVED DEFROSTING MODE

[75] Inventors: Franciscus Kokkeler, Malnate; Mario Fioroli, Brezzo di Bedero Varese, both of Italy; Per O. G. Risman, Herryda, Sweden; Liliana Vigano, Arese, Italy; Mats G. Idebro, Norrköping, Sweden

[73] Assignee: U.S. Philips Corporation, New York, N.Y.

[21] Appl. No.: 119,605

[22] Filed: Nov. 12, 1987

[30] Foreign Application Priority Data

Nov. 13, 1986 [SE] Sweden ..... 8604868
Feb. 5, 1987 [IT] Italy ..... 19263 A/87

[51] Int. Cl.[4] ..... H05B 6/68

[52] U.S. Cl. ..... 219/10.55 B; 219/10.55 R; 219/10.55 E; 99/325

[58] Field of Search ..... 219/10.55 B, 10.55 A, 219/10.55 R, 10.55 E, 10.55 M; 99/325, 451, DIG. 14

[56] References Cited

U.S. PATENT DOCUMENTS

| | | | |
|---|---|---|---|
| 3,467,804 | 9/1969 | Smith | 219/10.55 B |
| 4,351,999 | 9/1982 | Nagamoto et al. | 219/10.55 B |
| 4,396,817 | 8/1983 | Eck et al. | 219/10.55 M |
| 4,599,503 | 7/1986 | Ueda | 219/10.55 B |
| 4,692,597 | 9/1987 | Tsuda et al. | 219/10.55 B |

*Primary Examiner*—Philip H. Leung
*Attorney, Agent, or Firm*—Norman N. Spain

[57] ABSTRACT

A microwave oven is shown which has a defrosting mode the length of which is determined solely by the humidity in the air in the oven provided by moisture from a frozen article, particularly frozen food, being defrosted in the oven.

8 Claims, 2 Drawing Sheets

MICROWAVE OVEN WITH IMPROVED DEFROSTING MODE

BACKGROUND OF THE INVENTION

The invention relates to a microwave oven comprising an oven cavity in which an article to be heated is placed, a microwave generator for radiating microwave energy into said cavity for heating said article, fan means for producing an air flow in said cavity, humidity sensor means for sensing a change in humidity of the air in said cavity and control means for controlling the supply of energy to the article in dependence on the sensed humidity.

In particular, when the oven is operating in the defrost mode, the heating process can be rapid, causing the temperature in certain portions to rise to an unacceptably high level if the process is not interrupted in proper time. To avoid overheating it is then common practice to use a low power level so that on the one hand the process proceeds very slowly and is easier to check visually and on the other hand that due to the slow process more time is available for temperature equalization so that heat from overheated parts is led to colder parts.

It is difficult to control the defrosting process automatically because it is very difficult to detect the instantaneous defrosting condition. A known method is based upon the principle of sensing the variations in the dielectric properties taking place at the ice-water phase transition by means of microwave energy—if desired of another frequency than that of the energy supply. However, this method is inaccurate and often results in disturbances, on the one hand due to the fact that the geometry of the food varies and on the other hand due to the ionic conductivity caused by the salt content. Another known method is based upon the principle of sensing the weight of the article as a function of the energy supply. This method has also disadvantages. It does not enable the energy required for defrosing to be calculated in a sufficiently exact manner, because this energy, for equal weight, also depends to a substantial degree on the type of articles, its water content and its temperature on initiating defrosting. In addition, with this known method, account must also be taken of the weight of the plate or tray on which the article is disposed in the oven chamber. Because of these facts, the article is frequently overheated. If the defrosting mode is controlled by means of weight detection it is known to control the following cooking mode by means of humidity detection. In this method humidity detection is also operable during the defrosting mode if errors might occur in abnormal circumstances, e.g. when the article has been abnormally defrosted.

BRIEF SUMMARY OF THE INVENTION

The object of the present invention is to provide a microwave oven for automatically defrosting a frozen article, in which the defrosting condition of the article can be controlled in a more accurate manner than by using the known method, especially as regards the instant of interruption of the energy supply.

According to the invention a microwave oven of the kind described in the opening paragraph hereof is characterized in that the defrosting mode is controlled only by a sensed change in humidity.

The invention is based upon the discovery that the humidity of the air surrounding the frozen food initially decreases heavily by condensation on the food and that the humidity thereafter during the continued defrosting will rise at an increasing rate, which depends upon the fact that the vapour saturation pressure increases approximately exponentially with the temperature. By forcing the air to sweep past the food and measuring the humidity of the air swept past the food it is then possible to obtain a humidity indicating signal, which is a such an accurate measure of the defrosting condition of the food that it can be used to control the defrosting process.

DETAILED DESCRIPTION OF THE INVENTION

Figure 1:
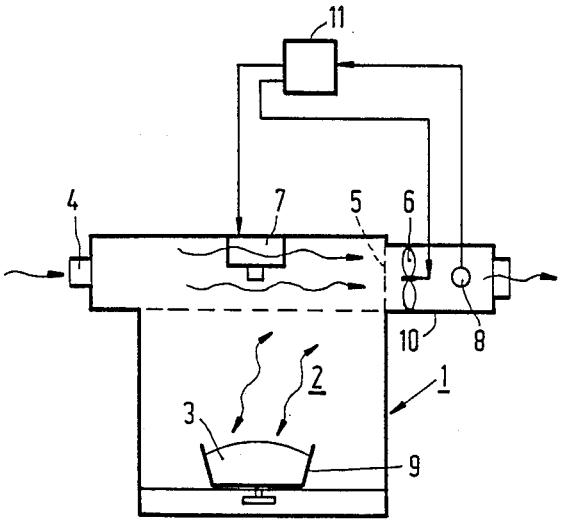
FIG. 1 is a diagrammatic view of a microwave oven having an "open system"

A prefered embodiment of the invention is characterized that said control means is arranged to detect a minimum humidity value, said defrosting being interrupted when, after said minimum valve is reached, the difference between said minimum humidity value and the detected humidity value reaches a predetermined value.

According to another embodiment of the invention the microwave oven is characterized in that the change in humidity corresponds to a humidity gradient and interruption of the defrosting mode is effected when the control means detect a predetermined positive humidity gradient.

According to one embodiment of the invention the microwave oven is characterized in that that the oven cavity has an inlet aperture in connection with the environmental air and an outlet aperture connected to an inlet of a channel, an outlet of which channel opens into the environment, said fan means being positioned inside the channel for producing said air flow from the environment into the oven cavity towards the channel an back to the environment, and said humidity sensor means being positioned inside the channel downstream the oven cavity. In such a microwave oven the humidity is sensed in a socalled "open system".

According to further embodiment said control means is operable to effect defrosting in cycles, each cycle having at least two periods, a first period in which both the generator and the fan are operating, and a second period in which both the generator and the fan are inoperative. Defrosting in cycles enables sensing of distinct humidity differences at the beginning of each on-period of a cycle in order to control the supply of energy accurately. During the period in which the microwave generator is switched off, colder parts of the article are heated by conduction from warmer parts.

In a further embodiment of the invention, said control means is operable to lengthen the first period of next cycles dependent on the detected humidity value with respect to the predetermined difference value after a predetermined number of cycles. This shortens the total defrosting time.

In a further embodiment said control means is operable to start defrosting with a first cycle in which the first period has a predetermined duration dependent on a minimum quantity of a critical article.

A further embodiment of the microwave oven according to the above mentioned invention is characterized in that outside the oven cavity both ends of the channel open into said oven cavity, said fan means being positioned inside the channel for producing said air flow to circulate in a closed loop, and said humidity sensor means being positioned inside the channel downstream the oven cavity. In this type of microwave oven the humidity is sensed in a so-called "closed system".

In microwave ovens humidity detection for controlling the process when the oven is in the cooking mode is well known. In that case the microwave oven must have an "open system". If in a microwave oven both defrosting and cooking modes are controlled by humidity sensing, a construction which enables switching from a "closed" to an "open system" is possible. Therefore an embodiment is characterized in that a branch-channel is provided, having one end opening into the channel and the other end opening into the environment, and in that at a junction of said channels there is provided a valve which can be switched between two positions, i.e. one position in which the air circulates in a closed loop and another position in which the air is blown into the environment.

The invention will be described in further detail with reference to the accompanying drawings.

In FIG. 1 the reference numeral 1 indicates the housing of a microwave oven, which comprises an oven cavity 2 in which the article 3 to be heated is placed. The oven cavity comprises an inlet aperture 4 in connection with the environmental air and an outlet aperture 5 connected to an inlet of a channel 10. The outlet of the channel opens into the environment.

A fan 6 is positioned in a channel 10 for producing an air flow in order to cool a magnetron 7, i.e. the microwave energy generator. The air passes at least partly through the oven cavity 2. Before being discharged into the external environment, the air flow or a fraction thereof passes a humidity sensor 8 of a known type disposed downstream of the oven cavity 2 with reference to the direction of the air flow. In order to distribute the microwave energy within the oven cavity, in known manner, but not shown, the article 3 is placed in an open container 9 which is either rotated by known drive means or is kept in a stationary position. In the latter case, a shaped and slotted disc (not shown) disposed in the upper part of the cooking chamber in front of the magnetron 7 is rotated by the suitably directed air flow.

The humidity sensor senses the absolute humidity in the oven cavity. The signal is led to a control means including a microprocessor for controlling the supply of energy to the oven cavity in dependence on the sensed change in humidity.

Figure 2:
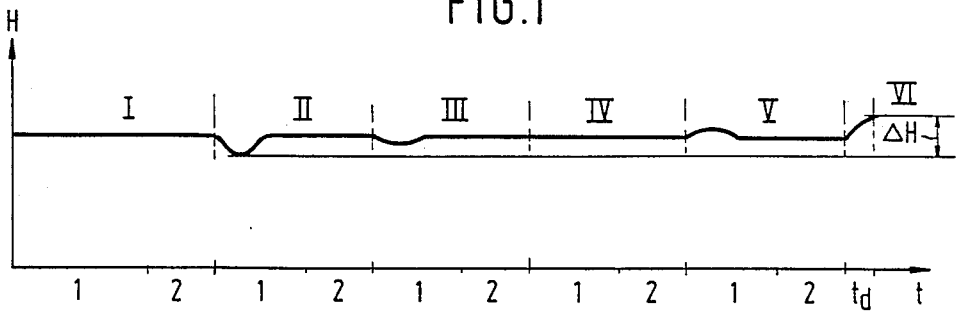
FIG. 2 is a humidity-time curve for a defrosting process in cycles for the oven of FIG. 1.
Figure 3:
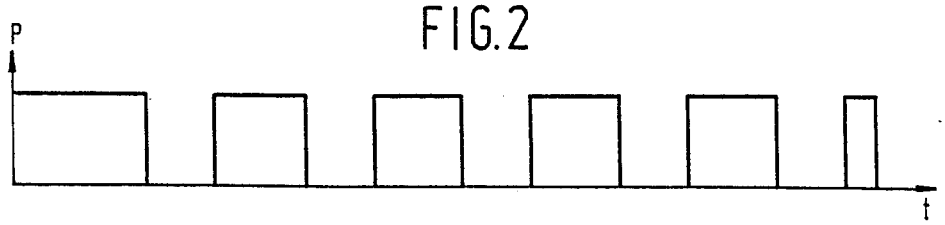
FIG. 3 is an energy-time curve corresponding with the curve of FIG. 2.

The process is illustrated in the curves of FIGS. 2 and 3. FIG. 2 shows an output signal corresponding to the humidity of the humidity sensor as function of the time t, and FIG. 3 shows the energy supply to the oven cavity, also as function of the time t.

Defrosting takes place in successive cycles I, II, III, IV, V, VI, . . . , each consisting of at least two periods 1 and 2. During the first period 1 of each cycle microwave energy is fed to the cavity and the fan 6 operates. During the second period 2 of each cycle no energy is supplied and the fan 16 is switched off. If desired a third period can be used, during which the fan operates but no energy is supplied to the cavity. Alternatively energy is supplied continuously and only the air fan is switched on and off.

During the first period 1 of the first cycle I the air humidity will be approximately equal to that of the surroundings due to the air circulation. When the fan 14 is switched off in the second period 2 of the cycle I the frozen food will influence the climate in the cavity. If the article is frozen, moisture will condense on the article and the air humidity in the cavity will decrease. When the air circulation is started during period 1 of the next cycle II the air is blown to the humidity sensor. The sensor delivers a signal, which during the first part of period 1 of cycle II shows a strong dip. This dip represents the decrease of the air humidity, which took place during the second period of cycle I. The same is repeated in period 1 of cycle III but the dip in the output signal from the humidity sensor is now smaller. In cycle IV there is no noticeable change of the humidity indicating signal from the humidity sensor when the fan is started in period 1 of the cycle. In the next cycle V a signal is obtained from the humidity sensor, which indicates an increase of the humidity in the cavity and in the next cycle VI a signal is obtained, which indicates a further increase of the air humidity. The defrosting process can be interrupted at an instant $t_a$ when the difference between the minimum humidity value corresponding to the dip in period 1 of cycle II and the detected humidity value in cycle VI, after having reached said minimum in cycle II, has reached a predetermined value $\Delta$ H. The duration of the period 1 of cycle I is related to the defrosting of a small quantity of a critical article, which has a low specific heat such as bread (e.g. a roll of 50 g).

Figure 4:
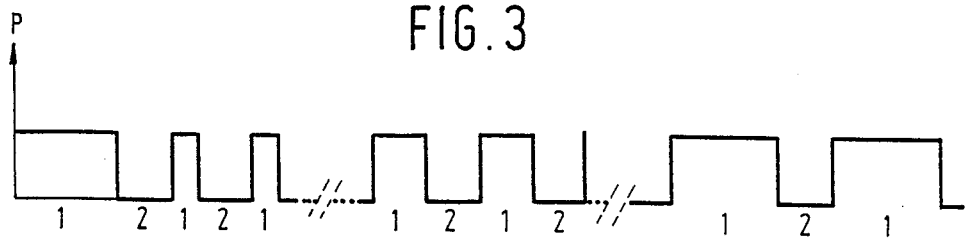
FIG. 4 is an energy-time curve similar to that shown in FIG. 3 but for a defrosting process with different cycles.

If the sensed change in humidity after a few cycles is only minor, the process may be increased by lengthening the first period of the next cycles and this may be repeated several times until the predetermined value $\Delta$ H is reached (see FIG. 4).

Figure 5:
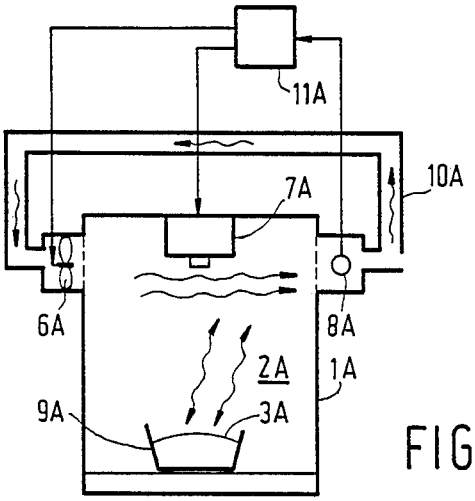
FIG. 5 is a diagrammatic view of a microwave oven having a "closed system"

In an alternative embodiment the air flow circulates in a closed loop as indicated in FIG. 5. The parts corresponding to the microwave oven of FIG. 1 are indicated by the same reference numerals accompanied by the letter A. Both ends of the channel 10A open into the oven cavity 2A. This system can only be used for a defrosting process. The food is then cold and does not deliver so large a quantity of moisture that condensation on the walls of the cavity can take place.

Figure 6:
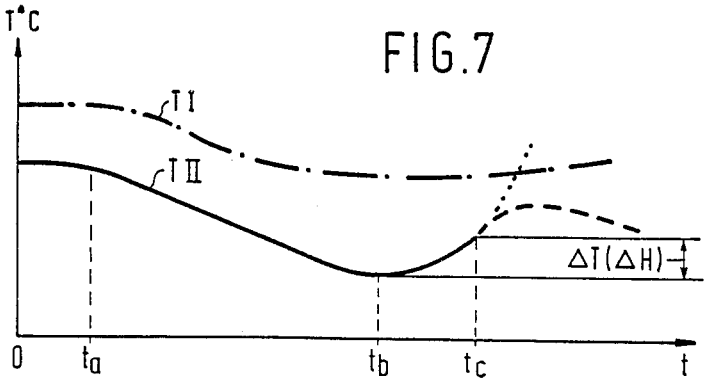
FIG. 6 is a humidity-time curve for a defrosting process in cycles for the oven of FIG. 5

FIG. 6 shows two typical waveforms for the process in the case of defrosting in a "closed system". The curve $T_I$ indicates the temperature of the air as a function of the time t and $T_{II}$ indicates the humidity of the air as a function of the time. For the sake of clarity the dew-point temperature of the air in the figure has been chosen for indicating the humidity. This magnitude has an unambiguous relationship with the absolute humidity.

Initially the temperature and the humidity in the oven cavity are the same as in the environment. When the frozen article is put into the oven cavity 2A and a magnetron is started the humidity will shortly start to decrease due to condensation on the cold surface and so will the temperature (time period $t_a$–$t_b$). A minimum of the humidity is reached at instant $t_b$. Then the surface of the food has been heated so much that the condensation has ceased. Simultaneously the air temperature in the cavity has decreased and at a given instant become so low that the heat supplied from the walls etc will prevent a further decrease. The temperature variation will, however, be essentially slower than the humidity variation.

During continued defrosting the humidity will start to rise at an increasing rate dependent upon the fact that the vapour saturation pressure in the air will increase approximately exponentially with the temperature. According to the invention the defrosting process is interrupted automatically at an instant which is determined by means of the measured humidity variation Δ H. The sole condition for switching off the oven may be that a certain dew-point temperature in the rising phase is reached, e.g. at the instant $t_c$ in FIG. 6. The dew-point temperature or the humidity then will follow the dashed curve in FIG. 6. If switching off has not occured the dew-point temperature should follow the dotted curve.

Alternatively the time derivative of the humidity curve can be used as a control parameter for switching off the oven. The humidity gradient is first negative, then zero, i.e. the minimum value of the humidity, then becomes positive. When a predetermined positive gradient is reached the magnetron is switched off. Furthermore, a second, higher value of the humidity gradient can be used as "safety cut-out independently of the extensions of the inventive idea given in the following.

In a more developed system the instant for switching off also depends, according to an experimentally determined function, on the time measure between starting and a given dew-point temperature being reached. By measuring this time a valuable correlation is obtained with the quantity of food, which can be utilized for extending the time beyond the instant when the "limit value" according to the selected switching-off criterium, with the humidity-indicating signal as control parameter, is reached.

In another embodiment the microwave power is controlled in dependence on the variation of the dew-point temperature in such a manner that the power supply is interrupted at a given limit value and then started again when the dew-point temperature (due to temperature equalization by conduction in the food) has decreased below another given, lower value. In this case the number of cycles can be fixed or can depend upon the time period up to the first interruption, according to an algorithm in which the number increases with the length of the said time period.

An embodiment in which the humidity of the surrounding room is utilized as correction parameter also falls within the scope of the inventive idea; the initial value in FIG. 6 is stored in a processor and if this value is relatively high then the limit value is adjusted according to the above so as to ompensate for the external influence.

In an additional embodiment the limit value is externally adjustable in a given interval. The user then can select "weak" defrosting (e.g. of fish blocks for fillet separation) or "strong" (e.g. for vegetables for further use). The adjustment possibility may also be used to compensate for manufacturing tolerances in the whole system, the user then being instructed to select an optimum position.

Figure 7:
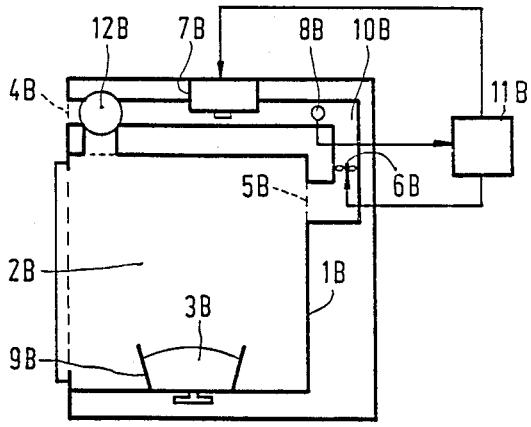
FIG. 7 is a diagrammatic view of microwave oven having both "systems".

If the defrosting process takes place in a "closed system" and the following cooking process is controlled by humidity sensing too, this control must take place in an oven with an "open system". A microwave oven having both modes is shown in FIG. 7. The parts are again indicated with the same reference numerals accompanied by a letter B. One end of the channel 8B opens into the cavity 2B, the other end into the environment. A branch-channel 10B is connected between the cavity and the channel 8B near the outlet opening. At the junction of said channels there is provided a valve 12B which can be switched between two positions, i.e. one position in which the air is circulating in a closed loop (defrosting mode), and the other position in which the air is blown into the environment (cooking mode).

What is claimed is

1. A microwave oven capable of operating in a defrosting mode for defrosting a frozen article comprising an oven cavity in which a frozen article to be defrosted is placed, a microwave generator for radiating microwave energy into said cavity for heating said article, humidity sensor means for sensing a change in the humidity of the air in said cavity, fan means for producing an air flow across said article to said humidity sensor means, control means for controlling the duration of the generation of microwave energy into said cavity radiated from said microwave generator in accordance with the humidity sensed by said humidity sensor means, characterized in that, when said oven is in said defrosting mode, said control means determining the duration of the generation of energy from said microwave generator into said cavity and therefore the duration of the defrosting mode solely in accordance with the change in humidity sensed by said humidity sensor means, said change in humidity corresponding to a humidity gradient and interruption of the defrosting mode is effected when the humidity sensor means detects a predetermined positive humidity gradient.

2. A microwave oven capable of operating in a defrosting mode for defrosting a frozen article comprising an oven cavity in which a frozen article to be defrosted is placed, a microwave generator for radiating microwave energy into said cavity for heating said article, humidity sensor means for sensing a change in the humidity of the air in said cavity, fan means for producing an air flow across said article to said humidity sensor means, control means for controlling the supply of microwave energy into said cavity radiated from said microwave generator in accordance with the humidity sensed by said humidity sensor means, characterized in that, when said oven is in said defrosting mode, said control means determining the duration of the generation of energy from said microwave generator into said cavity and therefore the duration of the defrosting mode solely in accordance with the change in humidity sensed by said humidity sensor means, said humidity sensor means being arranged to detect a minimum humidity value and said control means being arranged to interrupt said defrosting mode when, after said minimum humidity value is reached, the difference between said minimum humidity value and the sensed humidity value reaches a predetermined value.

3. A microwave oven as claimed in claim 2, characterized in that the oven cavity has an inlet aperture in connection with the environmental air and an outlet aperture connected to an inlet of a channel, an outlet of which channel opens into the environment, said fan means being positioned inside the channel for producing said air flow from the environment into the oven cavity towards the channel and back to the environment, and said humidity sensor means being positioned inside the channel downstream the oven cavity.

4. A microwave oven as claimed in claim 1 or 2, characterized in that a channel is provided outside the oven cavity, both ends of the channel open into said oven cavity, said fan means being positioned inside the channel for producing said air flow to circulate in a closed loop, and said humidity sensor means being positioned in the air flow inside the channel downstream the oven cavity.

5. A microwave oven as claimed in claim 4, characterized in that a branch-channel is provided, having one end opening into the channel, and the other end opening into the environment, and in that at a junction of said channels there is provided a valve which can be switched between two positions, one position in which the air circulates in a closed loop and another position in which the air is blown into the environment.

6. A microwave oven capable of operating in a defrosting mode for defrosting a frozen article comprising an oven cavity in which a frozen article to be defrosted is placed, a microwave generator for radiating microwave energy into said cavity for heating said article, humidity sensor means for sensing a change in the humidity of the air in said cavity, fan means for producing an air flow across said article to said humidity sensor means, control means for controlling the supply of microwave energy into said cavity radiated from said microwave generator in accordance with the humidity sensed by said humidity sensor means, characterized in that, when said oven is in said defrosting mode, said control means determining generator into said cavity and therefore the duration of the defrosting mode operating solely in accordance with the change in humidity sensed by said humidity sensor means, said humidity sensor means being arranged to detect a minimum humidity value and said control means being arranged to interrupt said defrosting mode when, after said minimum humidity value is reached, the difference between said minimum humidity value and the sensed humidity value reaches a predetermined value, said oven cavity is provided with an inlet aperture for air from the environment, and an outlet aperture connected to an inlet of a channel provided with an outlet opening to the environment, said fan means being positioned inside the channel for producing said air flow from the environment into the oven cavity towards the channel and back to the environment, and said humidity sensor means being positioned inside the channel downstream the oven cavity and wherein said control means is operable to effect defrosting in cycles, each cycle having at least two periods, a first period in which both the generator and the fan are operating, and a second period in which both the generator and the fan are inoperative.

7. A microwave oven as claimed in claim 6, characterized in that said control means is operable to lengthen the first period of next cylces dependent on the detected humidity value with respect to the predetermined difference value after a predetermined number of cycles.

8. A microwave oven as claimed in claim 7, characterized in that said control means is operable to start defrosting with a first cycle in which the first period has a predetermined duration dependent on a minimum quantity of a critical article.

* * * * *